United States Patent [19]

Focke

[11] Patent Number: 4,979,349

[45] Date of Patent: Dec. 25, 1990

[54] PACKAGING MACHINE FOR FLIP-TOP BOXES

[75] Inventor: Heinz Focke, Verden, Fed. Rep. of Germany

[73] Assignee: Focke & Co. (GmbH & Co.), Verden, Fed. Rep. of Germany

[21] Appl. No.: 342,420

[22] Filed: Apr. 24, 1989

[30] Foreign Application Priority Data

May 5, 1988 [DE] Fed. Rep. of Germany ..... 3815275

[51] Int. Cl.[5] ..... B65B 11/28; B65B 51/00

[52] U.S. Cl. ..... 53/234; 53/387; 198/803.9; 198/803.14; 198/803.15

[58] Field of Search ..... 53/137, 148, 151, 225, 53/234, 387; 198/470.1, 803.8, 803.9, 803.14, 803.15

[56] References Cited

U.S. PATENT DOCUMENTS

| | | | |
|---|---|---|---|
| Re. 29,847 | 11/1978 | Davies et al. . | |
| 3,884,143 | 5/1975 | Ackley | 198/803.14 X |
| 4,079,575 | 3/1978 | Focke et al. | 53/148 X |
| 4,084,393 | 4/1978 | Focke | 53/137 |
| 4,095,396 | 6/1978 | Seragnoli | 53/148 X |
| 4,308,708 | 1/1982 | Focke | 53/137 |
| 4,636,186 | 1/1987 | Focke et al. | 53/234 X |
| 4,708,704 | 11/1987 | Focke et al. . | |
| 4,718,216 | 1/1988 | Focke et al. | 53/234 X |
| 4,730,442 | 3/1988 | Focke et al. | 53/234 X |
| 4,750,607 | 6/1988 | Focket | 53/148 X |

*Primary Examiner*—Horace M. Culver

*Attorney, Agent, or Firm*—Sughrue, Mion, Zinn, Macpeak & Seas

[57] ABSTRACT

A transfer turret (20) is provided for the delivery of block-shaped (cigarette) packs (10) with rounded or bevelled longitudinal edges (11 . . . 14) from a feed conveyor (19) to a drying turret (37). Each of the pockets (21) of the transfer turret (20), respectively, is formed by a bottom (22) and two movable jaws (23, 24). The bottom (22) and the jaws (23, 24) have moulded edges (33 . . . 36), enabling the packs (10) to be held in a fixed position, i.e. to be calibrated, in the region of their longitudinal edges (11 . . . 14), i.e. their side tabs (17, 18), during delivery.

7 Claims, 3 Drawing Sheets

PACKAGING MACHINE FOR FLIP-TOP BOXES

BACKGROUND OF THE INVENTION

The invention relates to a packaging machine for flip-top boxes made of foldable material, such as cardboard or the like, having an essentially block-shaped configuration, for receiving, in particular, a cigarette group wrapped in an inner blank (tin-foil block), with a feed conveyor for feeding flip-top boxes to a transfer turret comprising several pockets for receiving one flip-top box each, and with a drying turret having pockets in which the flip-top boxes from the transfer turret can be inserted.

A packaging machine of this type is known from DE-OS 24 40 006 (corresponding to U.S. Pat. Nos. 4,308,708 and 4,084,393), whereby the transfer turret here serves for receiving cigarette packs from a rectilinear feed track to a drying turret. The packs are inserted into the open pockets of the transfer turret in radial direction and, after being transported to a suitable position, are pushed out of the pockets in axial direction and into pockets of a drying turret.

From EP-A 205,766 (corresponding U.S. Pat. No. 4,753,383) a flip-top box for cigarettes, or the like, is known, the longitudinal edges of which are rounded in deviation from the rectangular form in order to achieve a saving of material, first, and secondly, to improve the gripping properties of the box, that is, give it a more attractive appearance. A similar flip-top box, but with bevelled edges, is known from EP-A 204 933(corresponding to U.S. Pat. No. 4,753,384).

It now appears that the packaging machine described above shows good results in connection with the conventional rectangular flip-top boxes, but that difficulties arise when fabricating flip-top boxes with rounded or bevelled longitudinal edges, especially during gluing.

SUMMARY OF THE INVENTION

The object of the invention is to create a packaging machine which makes troubleproof production of flip-top boxes with rounded or bevelled longitudinal edges possible.

The packaging machine proposed for achieving this object comprises a transfer turret, the pockets of which are shaped to correspond to the longitudinal edges of the packs to be fabricated. Important here is the region of the longitudinal edges which are so constructed as to allow the flip-top boxes to fit interlockingly in the pockets, especially in this region. In this way the freshly glued packs are held in a fixed position so that calibration can take place in the transfer turret. The drying turret following may be constructed with rectangular pockets (as hitherto) which has the advantage of easy conversion of the packaging machine.

Also of an advantage is that the transfer turret constructed in this manner can take over part of the steps in folding, whereby the flip-top boxes, with side tabs glued but not completely folded over and fixed in the region of the longitudinal edges and side faces, are introduced into the pockets of the transfer turret. Both during the insertion as well as the final closing of the jaws forming the sides of the pockets, the side tabs are folded into their final position and fixed in this position until transfer to the drying turret.

Favourable further developments of the apparatus according to invention are characterized in the dependent claims.

The invention is explained in more detail below on the basis of two embodiments represented in the drawings. Shown are:

DETAILED DESCRIPTION OF THE PREFERRED EMBODIMENTS

The present packaging machine serves for producing block-shaped flip-top boxes 10 with rounded or bevelled edges. This type of "hard box" pack principally serves for receiving cigarettes.

Figure 1:
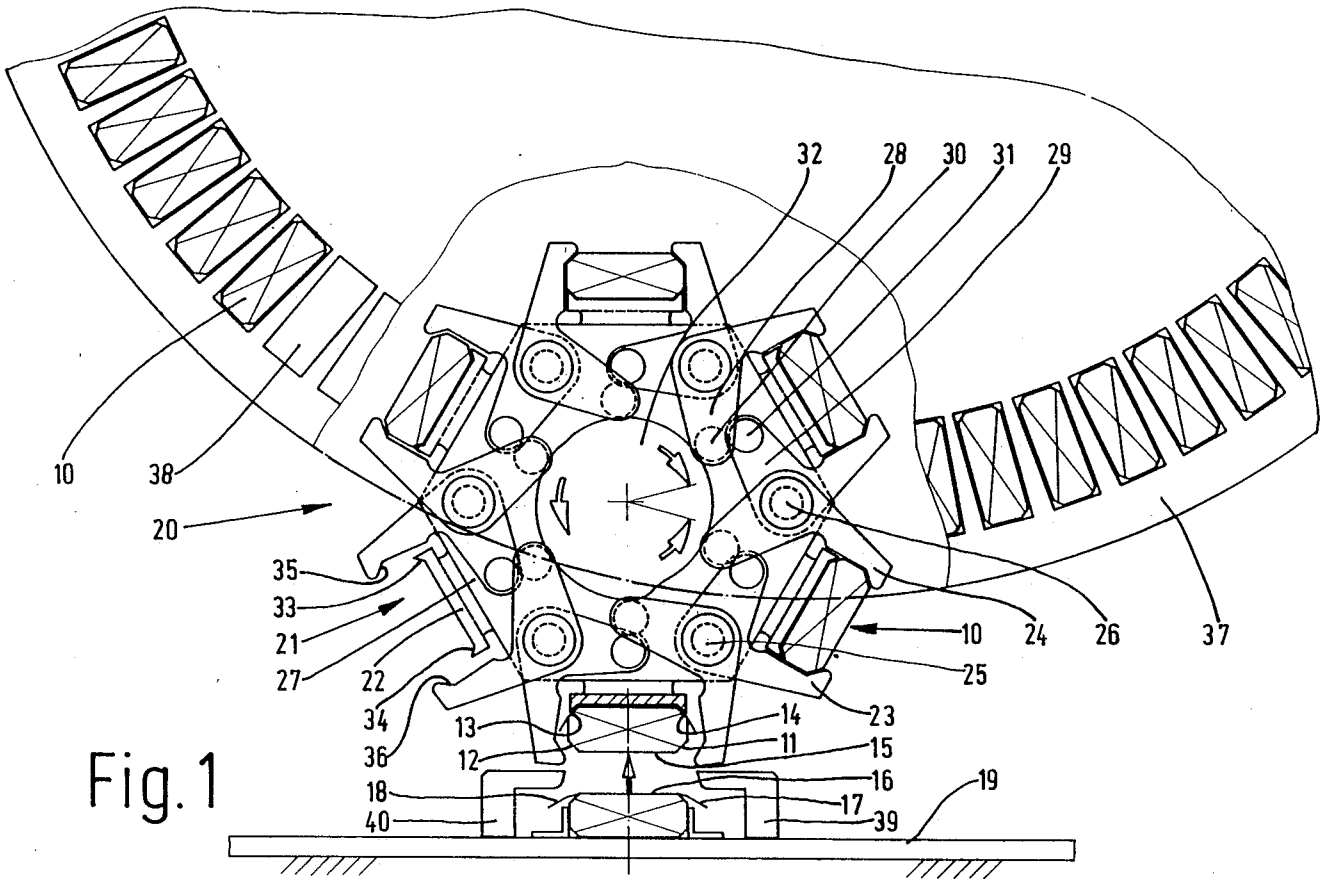
FIG. 1 a partial plan view of a transfer turret (for fabricating flip-top boxes with bevelled longitudinal edges) with the proper delivery conveyor and drying turret, FIG. 2 a partially sectional side view of the transfer turret according to FIG. 1, FIG. 3 a partial plan view of a transfer turret for fabricating flip-top boxes with rounded longitudinal edges.

As the figures show, the flip-top boxes 10 in question are those with bevelled or rounded longitudinal edges 11, 12, 13 and 14 (FIG. 1). In this connection, the boxes 10 are fed lying on their rear faces 15 with their front faces 16 up, whereby the side tabs 17, 18 projecting from the front faces 16 are provided with glue points on their inner surfaces but are not yet folded over, and fixed to, the corresponding side tabs connected with the rear faces 15.

Feed occurs via a feed conveyor 19 from which flip-top boxes 10 are movable, perpendicular to the rotational axis of a transfer turret 20.

In the embodiment shown, the transfer turret 20 comprises six pockets 21 (FIG. 3), each formed by one bottom 22 and two jaws 23, 24.

Figure 2:
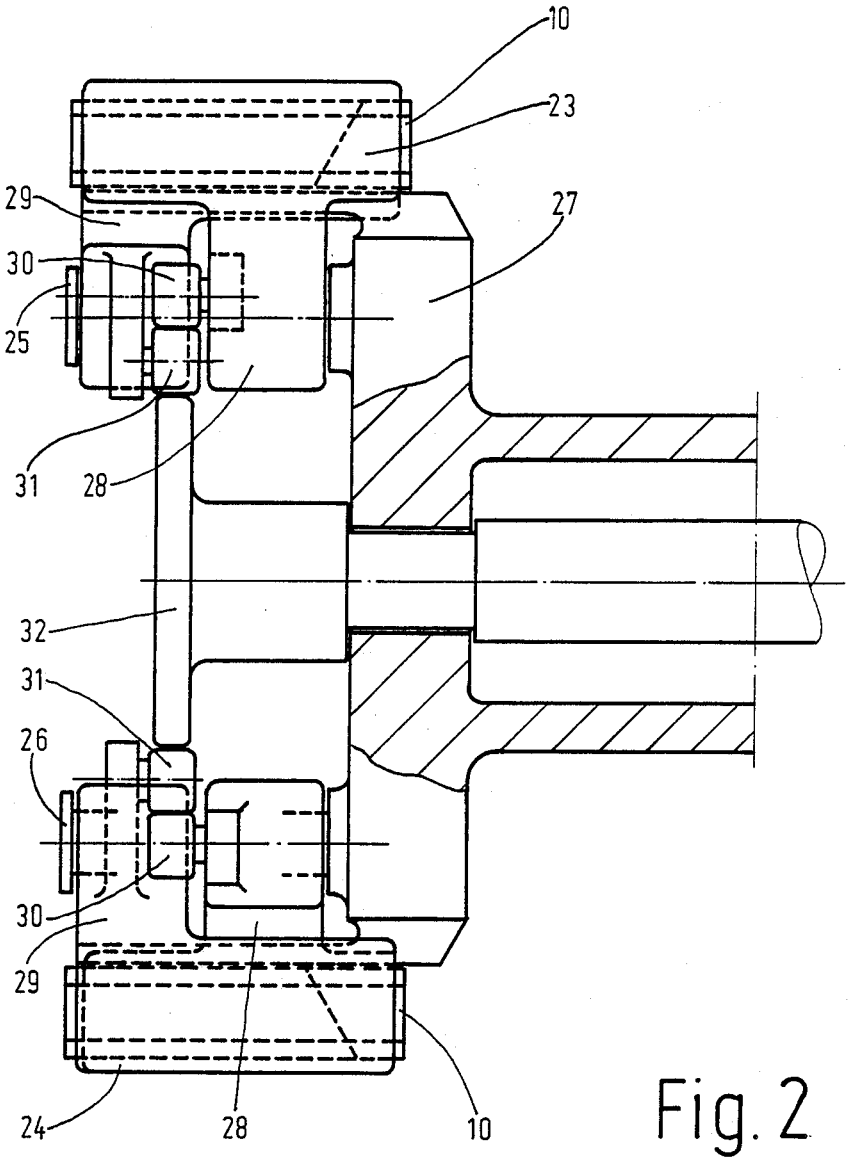

The jaws 23, 24 are mounted on pivots 25, 26 in a hinged arrangement. Said pivots project axially from a carrier plate 27 (FIGS. 1 and 2).

The jaws 23, 24 are moved via angle levers 28, 29 with guide rollers 30, 31 at their ends. Said rollers are directly or indirectly engaged with a cam disc 32. Thus, the movements of both jaws 23, 24 of each pocket 21 are effected simultaneously.

Each bottom 22 of a pocket 21 has moulded or shaped edges 33, 34 which essentially conform to the contour of the (front) longitudinal edges 13, 14 of the flip-top boxes 10. The open or free ends of the jaws 23, 24 have moulded or shaped edges 35, 36 which are formed to correspond to the (rear) longitudinal edges 11, 12 of the flip-top boxes 10.

The drying turret 37, to which the flip-top boxes 10 are delivered from the transfer turret 20, comprises a plurality of pockets 38, into which the flip-top boxes 10 can be pushed axially out of the pockets 21 of the transfer turret 20. The pushing here, out of the pockets 21 of the transfer turret 20 is effected such that after the jaws 23, 24 have reached a suitable relative position in relation to a pocket 38 of the drying turret 37, they are open only slightly so that there is practically no more friction between the flip-top boxes 10 and the inner surfaces of the pockets 21, but a radial drifting out of the pockets is certainly avoided.

Figure 3:
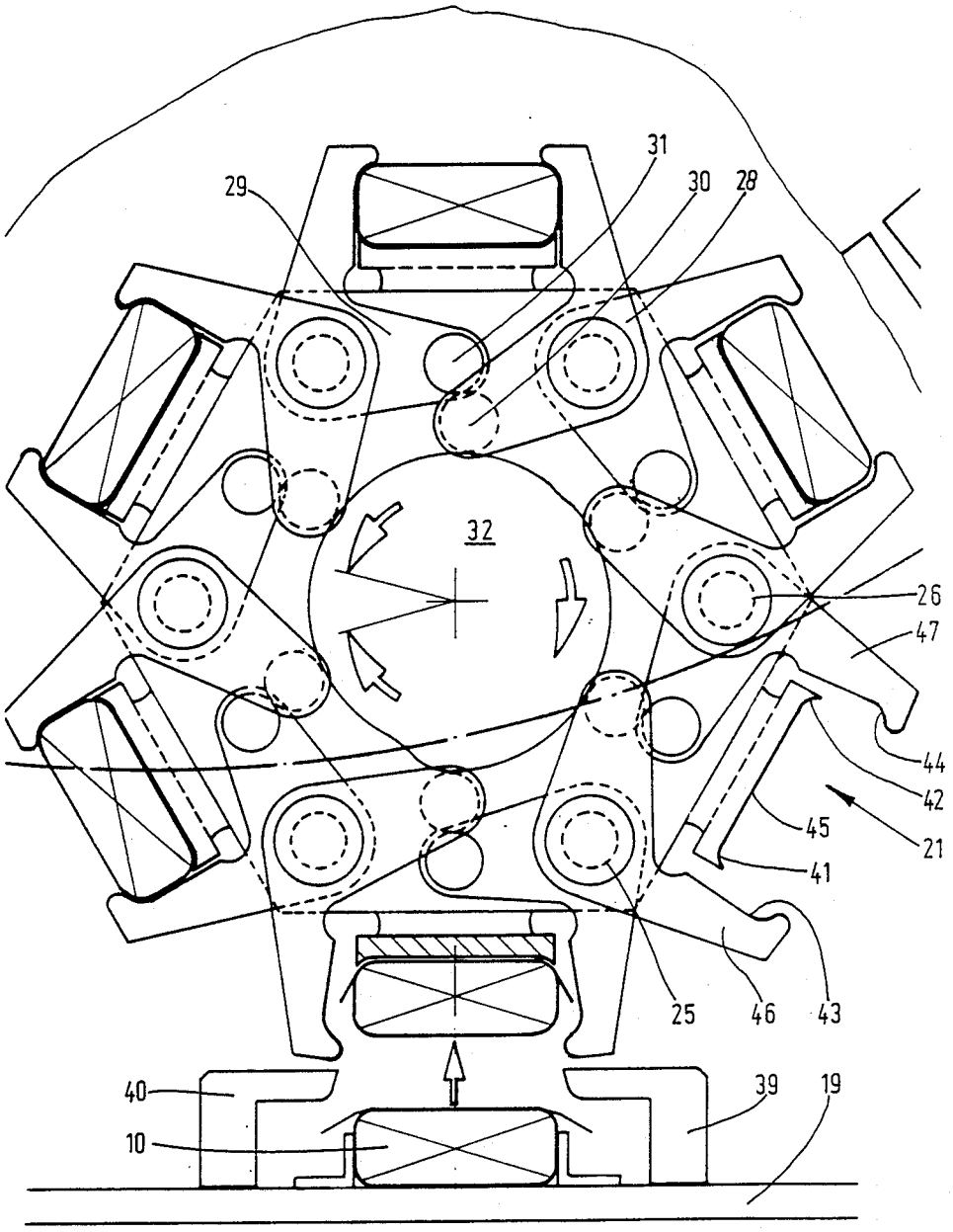

When moving a flip-top box 10 from the feed conveyor 19 into a pocket 21 of the transfer turret 20, the side tabs 17, 18 are bent over downwards via folding tongues 39, 40 (FIGS 1 and 3). When the front face 16 presses onto the bottom 22 of the pocket 21, the moulded edges 33, 34 press the side tabs 17, 18 against the region of the front longitudinal edges 13, 14. When closing the jaws 23, 24, the end sections of the side tabs 17, 18 are folded onto the corresponding side tabs, connected with the rear face 15, and held there in a fixed position. Thus, calibration of the freshly glued flip-top box is ensured during rotation of the filled pocket of the transfer turret into a position in which the flip-top box 10 is pushed into a pocket 38 of the drying turret 37. In this way, the pockets 38 of the drying turret 37 can retain the rectangular shape provided hitherto so that converting the machime for fabricating packages with a rectangular cross section is possible at any time.

FIG. 3 shows an embodiment of the transfer turret 20 for fabricating flip-top boxes 10 with rounded edges, whereby moulded edges 41, 42 and 43, 44 of a bottom 45 and/or of jaws 46, 47 of a pocket 21 are correspondingly constructed as grooves.

What is claimed is:

1. Packaging machine for flip-top boxes which have rounded or bevelled longitudinal outer edges, which are made of foldable material, such as cardboard or the like, and which have an essentially block-shaped configuration for receiving a cigarette group wrapped in an inner blank, said machine comprising:

feed conveyor means (19) for feeding said flip-top boxes to a transfer turret means (20) having several transfer pockets for receiving one flip-top box each from said feed conveyor means; and a drying turret having several drying pockets (38) adapted to receive respective flip-top boxes inserted from said transfer turret means;

wherein internal edges of each of said transfer pockets (21) form corners having a shape which conforms to the rounded or bevelled longitudinal edges (11..14) of the flip-top boxes (10), so that the longitudinal outer edges (11..14) of said boxes are received by the transfer pockets (21) in interlocking engagement with said internal edges of said transfer pockets.

2. Packaging machine according to claim 1, wherein each of said transfer pockets (21) of said transfer turret means (20) comprises two movable jaws (23, 24; 46, 47) and a bottom wall (22, 45) lying between them.

3. Packaging machine according to claim 2, wherein each of said boxes has four said longitudinal edges;

wherein said jaws (23, 24; 46, 47) have open free ends, which are opposite said bottom wall (22, 45) and each of which has a shaped edge (35, 36; 43, 44) which conforms to one of said longitudinal edges (11, 12), respectively, of the flip-top boxes (10); and wherein said bottom wall (22, 45) has two shaped edges (33, 34; 41, 42) which conform to the two remaining longitudinal edges (13, 14) of the flip-top boxes (10).

4. Packaging machine according to claim 2, wherein said feed conveyor means (19) feeds to said transfer turret means (20) each flip-top box (10) with the side tabs ( 17, 18) thereof which carry glue spots but which are projecting outwardly and are not completely folded over or fixed at two of said longitudinal edges (13, 14) and at side faces of the box; said machine further comprising tabfolding means (39, 40) for folding over and downwardly the side tabs (17, 18) prior to their being pressed into a position in which they are fixed until delivery to the drying turret (37).

5. Packaging machine according to claim 4, wherein said feed conveyor means (19) conveys the flip-top boxes (10) to a position vertically aligned with the bottom wall (22, 45) of a transfer pocket (21) of the transfer turret means (20), thus enabling the side tabs (17, 18) to be passed and held fixed, first against the rounded or bevelled longitudinal edges (13, 14) by means of the shaped edges (33, 34; 41, 42) of the bottom wall (22, 45) and, then, against the side faces by means of the shaped edges 835, 36; 43, 44) of the jaws (23, 24; 46, 47).

6. Packaging machine according to claim 1, wherein the drying pockets (38) of the drying turret (37) have square inner corners forming a rectangular inner contour so that said flip-top boxes (10) inserted into the drying pockets (38) are engaged thereby essentially in an interlocking manner except for regions of the rounded or bevelled longitudinal edges (11..14) of the boxes (10).

7. Packaging machine according to claim 2, wherein, in order to simultaneously take up, convey and deliver two flip-top boxes (10), the transfer turret means (20) has a pocket unit comprising two pockets lying adjacent to one another in a plane, whereby the jaws assigned to one pocket unit can be moved simultaneously in an open or closed position.

* * * * *